US006332300B1

(12) United States Patent
Wakai

(10) Patent No.: US 6,332,300 B1
(45) Date of Patent: Dec. 25, 2001

(54) DOUBLE WALL COUPLING TOOL

(75) Inventor: Takao Wakai, Osaka (JP)

(73) Assignee: Wakai & Co., Ltd., Osaka (JP)

( * ) Notice: Subject to any disclaimer, the term of this patent is extended or adjusted under 35 U.S.C. 154(b) by 0 days.

(21) Appl. No.: 09/477,703

(22) Filed: Jan. 5, 2000

(30) Foreign Application Priority Data

Jan. 8, 1999 (JP) ..... 11-002801

(51) Int. Cl.[7] ..... E04C 5/00

(52) U.S. Cl. ..... 52/713; 52/562; 52/379; 52/712; 52/426

(58) Field of Search ..... 52/698, 699, 407.4, 52/426, 513, 379, 568, 565, 712, 713, 714, 562

(56) References Cited

U.S. PATENT DOCUMENTS 3,786,605 * 1/1974 Winfrey ..... 52/235
4,194,337 * 3/1980 Fischer ..... 52/713
4,619,093 * 10/1986 Gandillon ..... 52/311.2
4,622,796 * 11/1986 Aziz et al. ..... 52/747
5,119,567 * 6/1992 Fox ..... 33/526
5,456,052 * 10/1995 Anderson et al. ..... 52/713
5,687,522 * 11/1997 Durand et al. ..... 52/414

* cited by examiner

*Primary Examiner*—Carl D. Friedman
*Assistant Examiner*—Jennifer I. Thissell
(74) *Attorney, Agent, or Firm*—Wenderoth, Lind & Ponack, L.L.P.

(57) ABSTRACT

A coupling tool for a double wall is proposed which makes it possible to join an inner and an outer wall together without selecting places while ensuring a sufficient joint strength. The coupling tool is formed by an anchor formed by superposing two metallic plates so as to be spreadable, and a wire of a required length mounted to one end of the anchor. The wire is fixed to the anchor so as to protrude from an end opposite to the tip of the anchor. Since the anchor can be driven into the inner wall at any position, the outer wall can be fixed to the inner wall by use of the coupling tool without selecting places and number.

9 Claims, 7 Drawing Sheets

DOUBLE WALL COUPLING TOOL

BACKGROUND OF THE INVENTION

This invention relates to a coupling tool for a double wall used to construct a double-walled building.

As shown in FIGS. 7 through 9, a double wall of a building has an inner wall 4 formed by laying ALC (aerated light-weight concrete) blocks 2 on base concrete 1 at an inner position and joining the seams between them by mortar 3, and an outer wall 7 formed by laying stones or bricks 5 at a position spaced a predetermined distance outwardly from the inner wall 4 and joining the seams by mortar 6, thereby defining a space 8 which is an air layer between the inner wall 4 and the outer wall 7. The space 8 provides heat insulation and dew formation preventive effect.

With this double wall, ALC blocks 2 forming the inner wall 4 are large and heavy, and thus show good stability during laying. In contrast, since stones or bricks 5 forming the outer wall 7 are small, the stability during laying is poor. Thus, it is necessary to couple and fix the outer wall 7 to the inner wall 4 to prevent the former from falling.

Heretofore, in a method for fixing the outer wall 7 to the inner wall 4, as shown in FIG. 9, coupling tools 9 formed by bending both ends of a metallic wire in the shape of L have been used. When ALC blocks 2 are laid, ends of coupling tools 9 are inserted in the seams between upper and lower ALC blocks 2 at suitable positions and buried in mortar 3 as shown in FIG. 7. When the outer wall 7 is constructed, the other ends of the coupling tools 9 are inserted in the seams between upper and lower stones or bricks 5 and buried in mortar 6. The coupling tools 9 serve to couple the inner wall 4 and the outer wall 7 together, thereby preventing the outer wall 7 from falling outwardly.

By the way, since the conventional coupling tools 9 extend between the seams between upper and lower ALC blocks 2 and the seams between upper and lower stones or bricks 5, they can be used only at portions where their seams align with each other.

But, since ALC blocks 2 and stones or bricks 5 are different in size from each other, when they are laid, there are only a few portions where the height levels of the respective seams coincide. Thus there are only a few locations where the inner wall 4 and the outer wall 7 can be coupled together by coupling tools 9. It was thus impossible to ensure a sufficient strength of joint of the outer wall 7 to the inner wall 4.

An object of this invention is to provide a coupling tool for a double wall which makes it possible to join an inner wall and an outer wall together at any height position, whereby the inner and outer walls can be joined together without selecting places, thereby ensuring a sufficient joint strength.

SUMMARY OF THE INVENTION

According to this invention, there is provided a coupling tool for a double wall comprising an anchor, and a wire of a required length mounted to one end of the anchor.

Other features and objects of the present invention will become apparent from the following description made with reference to the accompanying drawings, in which:

DETAILED DESCRIPTION OF THE PREFERRED EMBODIMENT

Hereinbelow, embodiments of this invention are described with reference to the accompanying drawings.

Figure 1A:
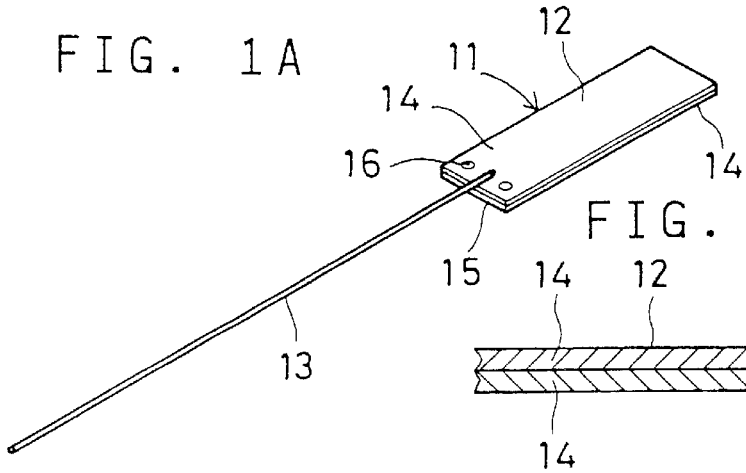
FIG. 1A is a perspective view showing a coupling tool of a first embodiment.
Figure 1B:
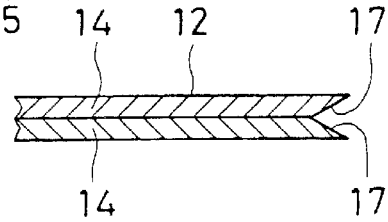
FIG. 1B is an enlarged sectional view showing the tip structure of an anchor of the same.

The coupling tool 11 of a first embodiment shown in FIG. 1 comprises an anchor 12 and a wire 13 of a required length mounted to one end of the anchor 12. The anchor is formed by superposing two rectangular metal plates 14 of e.g. stainless steel one on the other, joining one end 15 only together by e.g. spot welding 16, and providing slopes 17 on their opposed surfaces at an opposite end (FIG. 1B). The wire 13 is a bendable metal wire, and is fixed as by welding to the anchor 12 so as to axially protrude from an end opposite to the front end of the anchor 12. The slope 17 of the anchor 12 may be formed on only one of the metallic plates 14.

Figure 2:
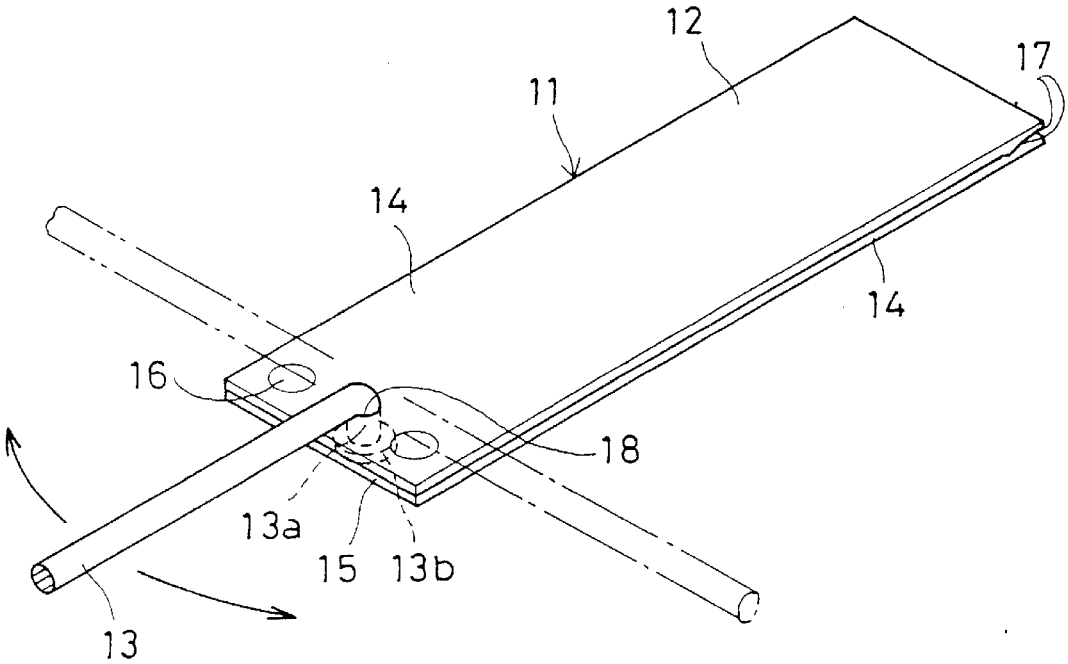
FIG. 2 is a perspective view showing a second embodiment.

The coupling tool 11 of a second embodiment shown in FIG. 2 comprises an anchor 12 similar to that of the first embodiment, and a wire 13 of a required length pivotably attached to one end of the anchor 12. For this pivotable structure, a through hole 18 is formed in the anchor 12 near the end 15, a perpendicularly bent portion 13*a* formed at one end of the wire 13 is inserted through the hole 18, and a large-diameter portion 13*b* is formed by pressing at the end of the bent portion 13*a*, so that it will not come out of the hole 18.

By pivotably mounting the wire 13 to the anchor 12, the wire 13 can be changed from the state of use in which it protrudes from an end opposite to the front end of the anchor to the lateral position as shown in FIG. 2 by dotted line, or to the folded position in which it is superposed on the anchor 12. In particular, while not in use, it is possible to shorten the entire length by moving the wire to the folded position.

Figure 3:
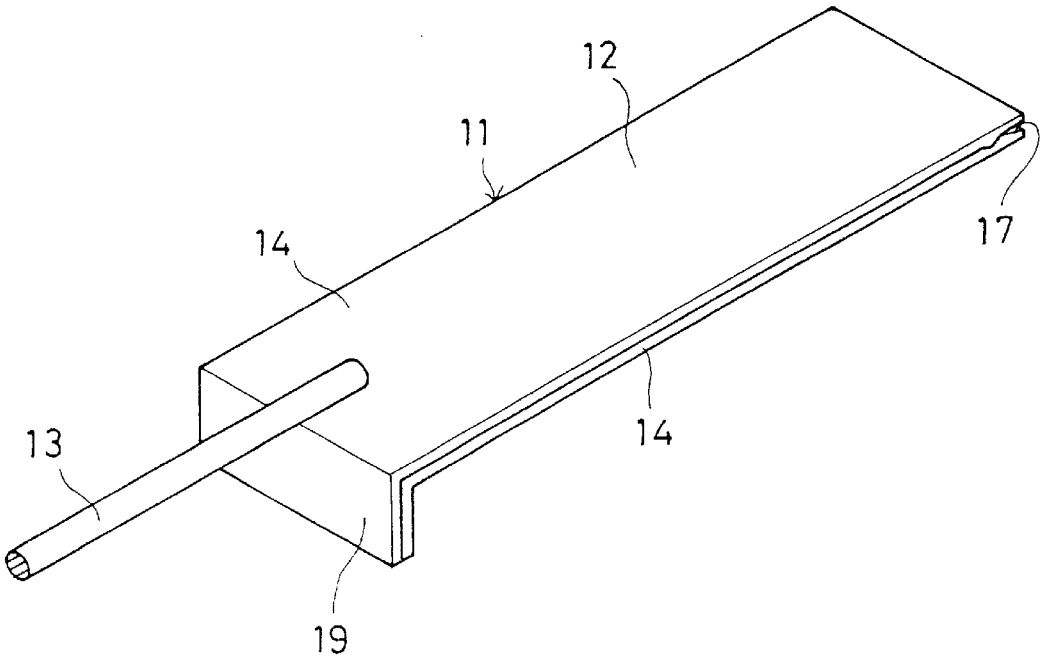
FIG. 3 is a perspective view showing a third embodiment.

The coupling tool of a third embodiment shown in FIG. 3 comprises an anchor 12 formed with a bent head 19 at the striking end 15. For the basic structure of the coupling tool 11, either of the structures of the first and second embodiments may be employed.

Figure 4:
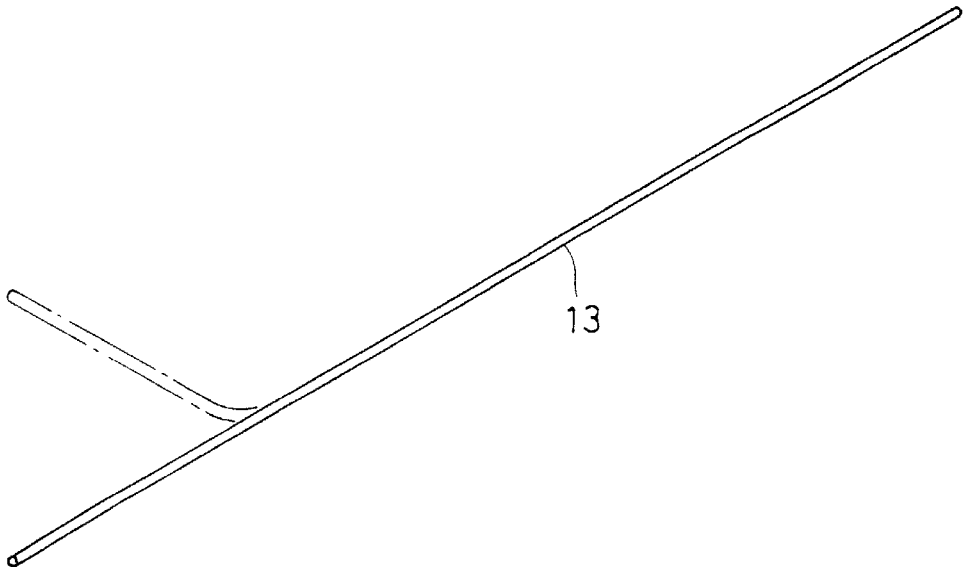
FIG. 4 is a perspective view showing the end of a wire.

In any of the embodiments, the anchor 12 may be formed by bending a single long metallic plate in half. The wire 13 should have a diameter such that it can be inserted in the joints or seams of stones or bricks 5 (FIG. 5) and a length slightly longer than the distance from the outer surface of the inner wall 4 to the center of the outer wall 7. In FIG. 4, its free end side is shown straight but bent perpendicularly at the time of use. But the free end of the wire 13 may be bent perpendicularly beforehand.

The coupling tool of this invention has a structure as described above. We shall describe how to use it in constructing a double wall of a building.

Figure 5:
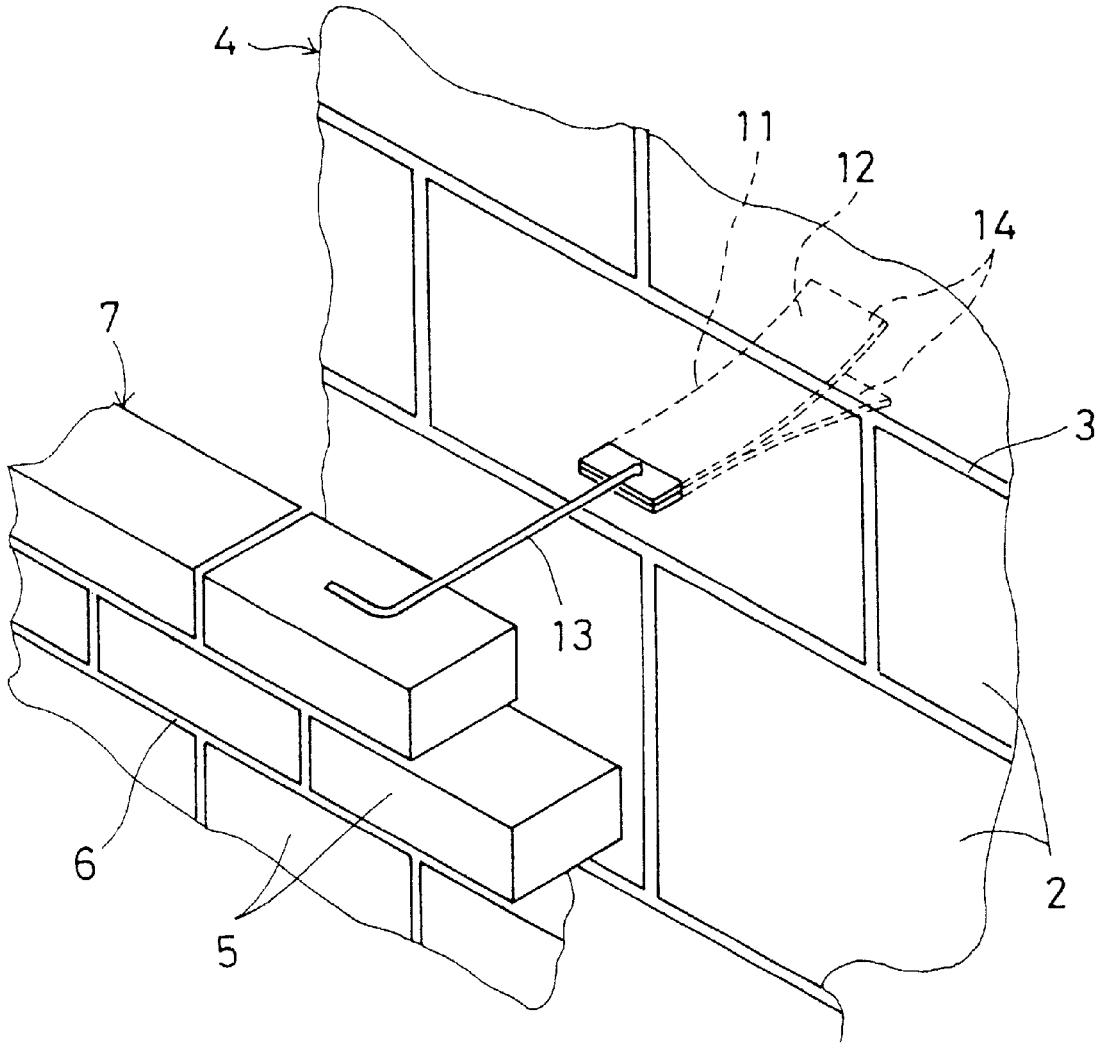
FIG. 5 is a perspective view showing how a double wall is constructed using the coupling tool.
Figure 6:
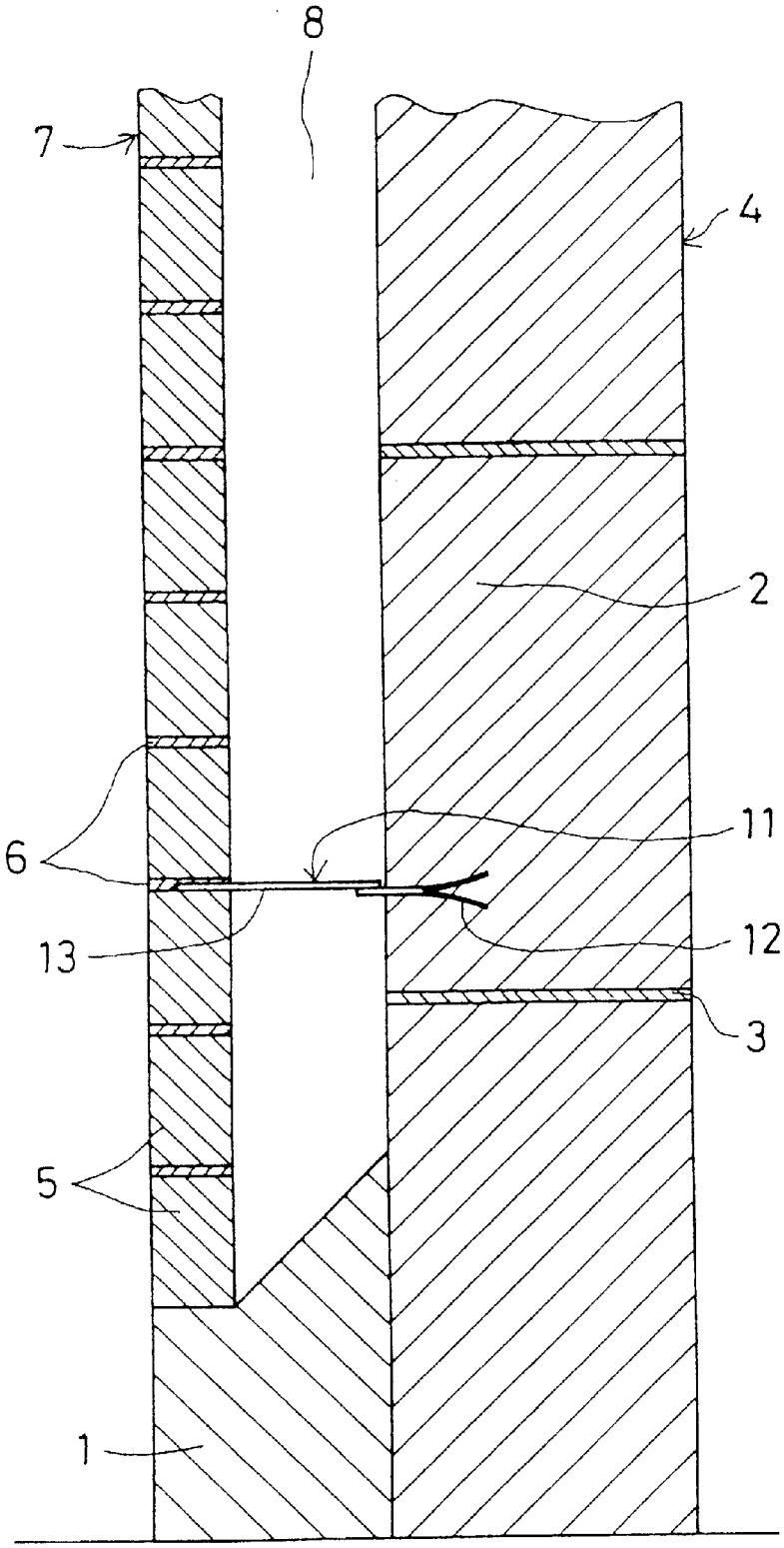
FIG. 6 is a vertical sectional view showing a double wall constructed using the coupling tool.
Figure 7:
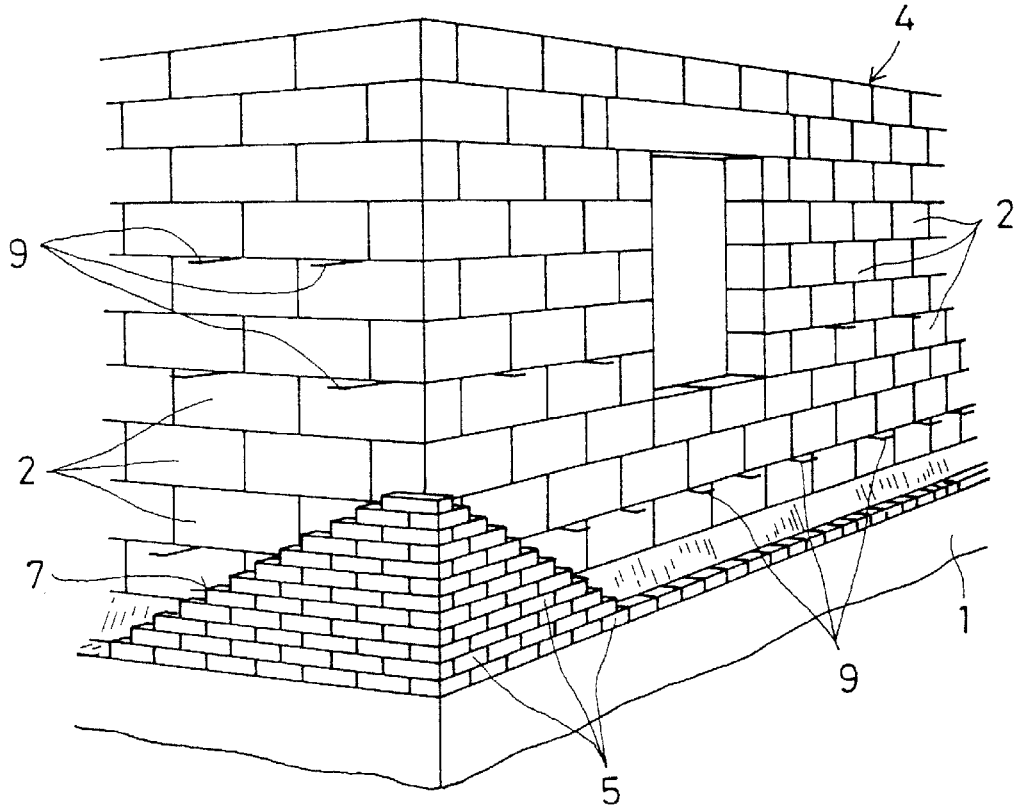
FIG. 7 PRIOR ART
FIG. 7 is a perspective view showing a double wall constructed using conventional coupling tools.
Figure 8:
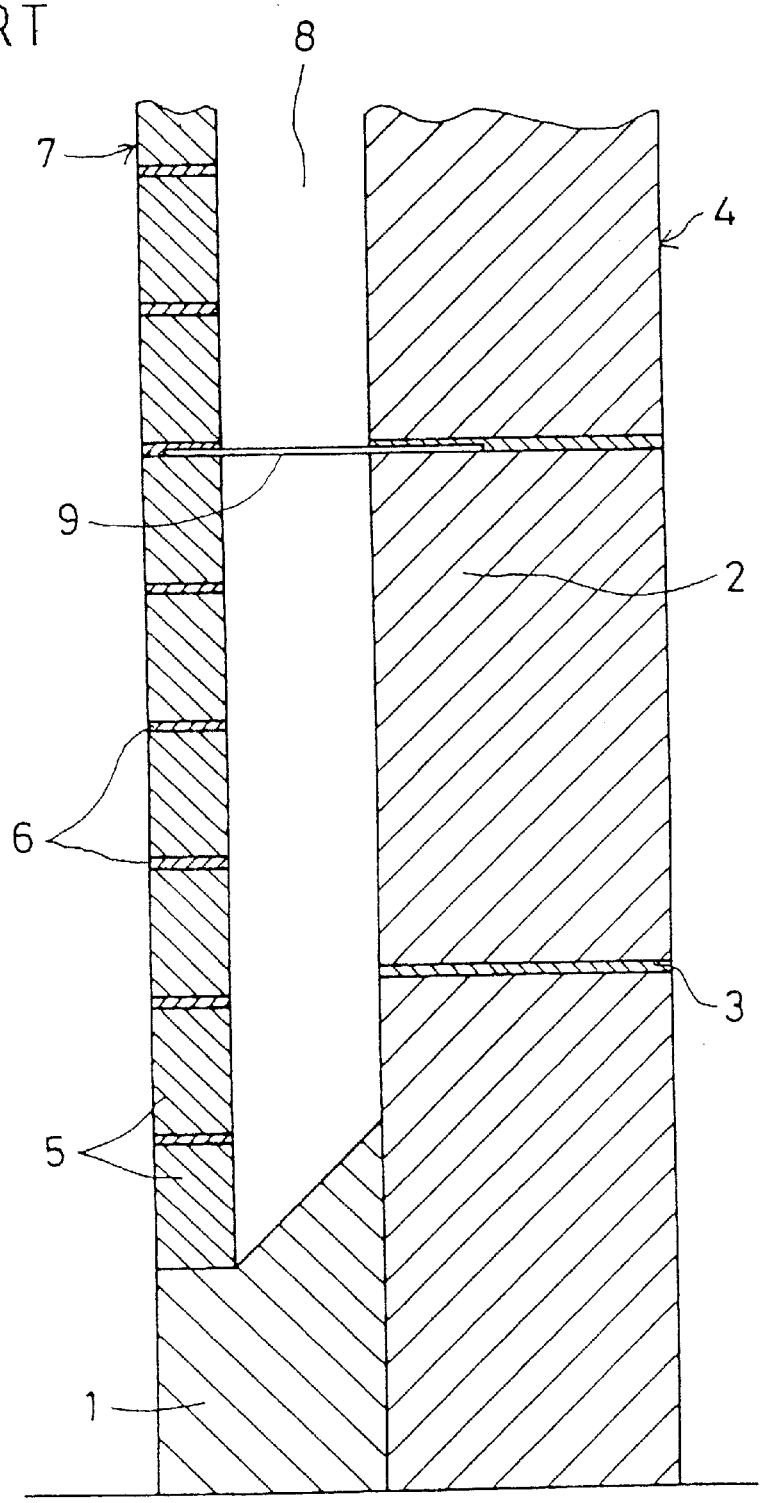
FIG. 8 PRIOR ART
FIG. 8 is a vertical sectional view of the same.
Figure 9:
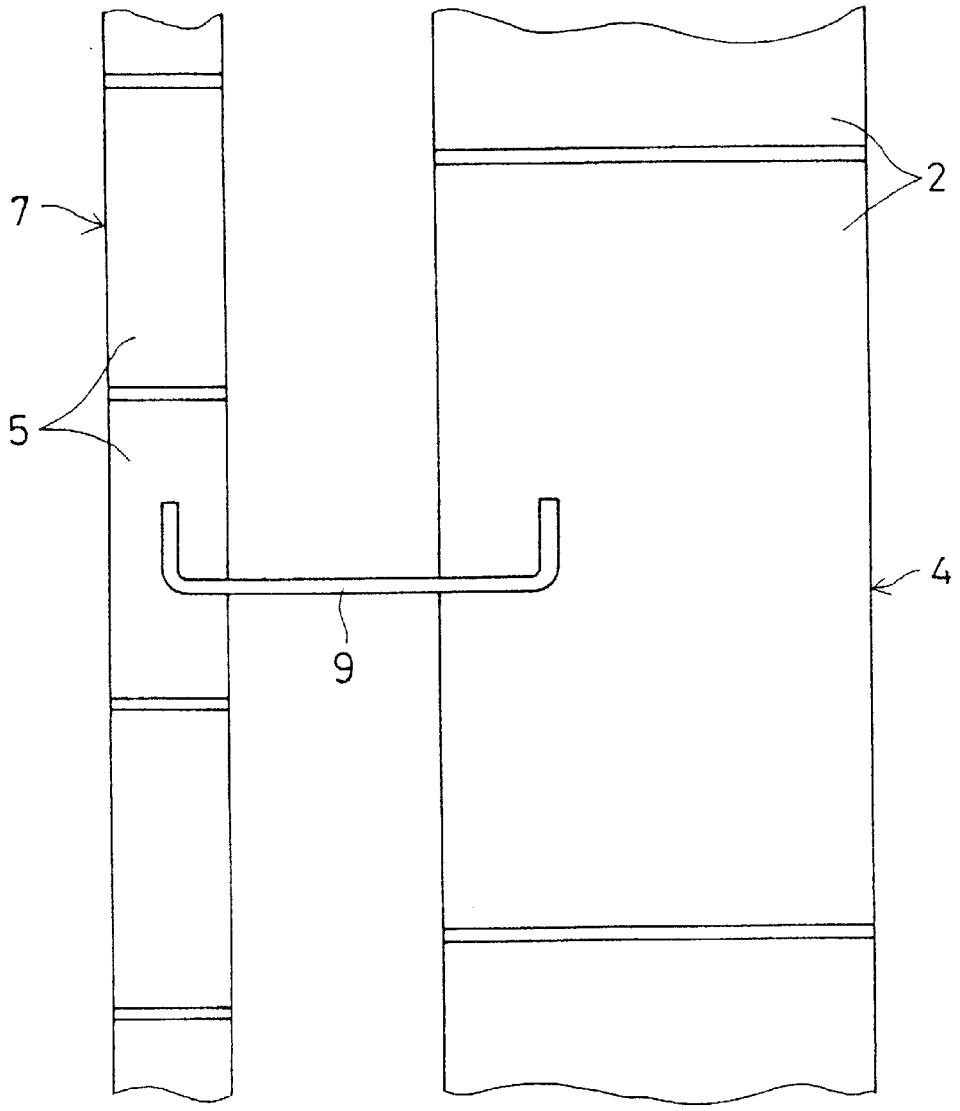
FIG. 9 PRIOR ART
FIG. 9 is a plan view of the same.

As shown in FIG. 5, an inner wall 4 is constructed by laying ALC blocks 2 on a concrete base, and joining them by mortar 3. Next, an outer wall 7 is constructed by laying stones or bricks 5 at a position spaced a predetermined distance outwardly from the inner wall 4.

During construction of the outer wall 7, when stones or bricks have been laid to a predetermined height, the anchors 12 of coupling tools 11 are driven into ALC blocks 2 of the inner wall 4 at positions corresponding to the top level of the stones or bricks 5.

The wires 13 of the coupling tools 11 are bent at the free ends perpendicularly in the horizontal direction beforehand. By striking, each anchor 12 is driven into an ALC block 2. As it is driven in, the two metal plates 14 will spread while being bent in opposite directions to each other by the formation of the slopes 17, thus producing resistance to pulling force.

With the coupling tool 11 of the second embodiment shown in FIG. 2, in which the wire 13 is pivotally mounted, if the wire 13 is positioned to extend laterally as shown by the two-dot line in FIG. 2, no protruding member is present at the end 15 of the anchor 12, so that driving of the anchor 12 by a tool such as a hammer can be carried out smoothly without trouble.

When the anchor 11 is driven into an ALC block 2 of the inner wall 4, as shown in FIG. 5, the bent end of the wire 13 is superposed on the top of a stone or brick 5. By continuing laying of stones or bricks 5 one upon another, the bent end of the wire 13 is received in the joint between upper and lower stones or bricks and buried in mortar 6. By the engagement between the bent end of the wire 13 and mortar 6, and by the fixing of the anchor 12 to the ALC block 2, the outer wall 7 is fixed to and held by the inner wall 4 through the coupling tool 11.

In this way, during laying of stones or bricks 5, at any height position, the coupling tool 11 can be driven into an ALC block 2. Fixing of the outer wall 7 to the inner wall 4 can thus be carried out at any position and in any number. It is also possible to markedly improve the fixing/holding strength of the outer wall 7.

As described above, according to this invention, since a wire of a required length is mounted to the end of the anchor, in constructing a double wall, it is possible to drive in the anchor into the inner wall at predetermined positions, so that fixing of the outer wall to the inner wall can be carried out without selecting places and number. The fixing/holding strength of the outer wall thus greatly improves.

Also, since a wire of a required length is pivotably mounted to one end of an anchor, the wire does not get into the way during driving of the anchor. Thus, driving of the anchor can be carried out smoothly. Also, before use, the entire device can be made short so that it can be kept small in volume. This is convenient for transportation.

What is claimed is:

1. A coupling tool for a double wall, comprising an anchor, and a wire of a required length mounted to one end of said anchor, wherein said wire is fixed to said anchor to extend longitudinally so as to protrude from said end of said anchor, wherein said anchor is formed by superposing two metallic plates, and coupling them together at one end thereof, at least one of said metallic plates being formed with an inclined surface at its tip on its side opposite the other of said metallic plates.

2. The coupling tool for a double wall as claimed in claim 1 wherein said wire is made from a bendable metallic material.

3. The coupling tool for a double wall as claimed in claim 1 wherein the free end of said wire is bent.

4. A coupling tool for a double wall, comprising an anchor, and a wire of a required length mounted to one end of said anchor, wherein said anchor is formed by superposing two metallic plates, and coupling them together at one end thereof, at least one of said metallic plates being formed with an inclined surface at its tip on its side opposite the other of said metallic plates.

5. The coupling tool for a double wall as claimed in claim 4, wherein said wire is pivotably mounted to said anchor.

6. The coupling tool for a double wall as claimed in claim 4 wherein said wire is made from a bendable metallic material.

7. The coupling tool for a double wall as claimed in claim 5 wherein said wire is made from a bendable metallic material.

8. The coupling tool for a double wall as claimed in claim 4 wherein the free end of said wire is bent.

9. The coupling tool for a double wall as claimed in claim 5 wherein the free end of said wire is bent.

* * * * *